US006634903B2

(12) United States Patent
Gunreben et al.

(10) Patent No.: US 6,634,903 B2
(45) Date of Patent: Oct. 21, 2003

(54) PLUG CONNECTOR WITH STRAIN RELIEF CLAMP

(75) Inventors: Michael Gunreben, Feucht (DE); Vincent Regnier, Nuremberg (DE); Bernhardt Kuhnel, Altdorf (DE)

(73) Assignee: FCI, Courbevoie (FR)

( * ) Notice: Subject to any disclaimer, the term of this patent is extended or adjusted under 35 U.S.C. 154(b) by 0 days.

(21) Appl. No.: 10/054,570

(22) Filed: Jan. 22, 2002

(65) Prior Publication Data

US 2002/0115336 A1 Aug. 22, 2002

(30) Foreign Application Priority Data

Jan. 22, 2001 (DE) ..... 101 02 688

(51) Int. Cl.[7] ..... H01R 13/58
(52) U.S. Cl. ..... 439/459
(58) Field of Search ..... 439/459, 456, 439/620, 492, 466, 468

(56) References Cited

U.S. PATENT DOCUMENTS 3,336,565 A * 8/1967 Crimmins ..... 439/459
3,813,634 A * 5/1974 Wigby et al. ..... 439/459
4,734,055 A * 3/1988 Misu ..... 439/456
5,217,389 A * 6/1993 MacKay et al. ..... 439/459
5,266,048 A 11/1993 Brekosky et al. ..... 439/470
5,575,681 A 11/1996 Muzslay et al. ..... 439/459
5,599,202 A * 2/1997 Key ..... 439/459
5,626,491 A * 5/1997 Hasircoglu ..... 439/459
5,741,147 A * 4/1998 Konoya et al. ..... 439/459
6,428,345 B2 * 8/2002 Sawayanagi et al. ..... 439/459
6,443,765 B2 * 9/2002 Ichio et al. ..... 439/459

FOREIGN PATENT DOCUMENTS

GB 2069254 * 8/1981 ..... 439/459

* cited by examiner

*Primary Examiner*—Gary Paumen
(74) *Attorney, Agent, or Firm*—Perman & Green, LLP

(57) ABSTRACT

The present invention relates to a plug connector with a first lower housing part in which contact ends are arranged in a plug, crimp plates to the back end of which a flat conductor strip is crimped and the front end of which is connected with the contact ends, possibly with the interposition of a choke or another electronic component, a second housing part which is inserted as a cover on the first housing part and a third housing part inserted on the first housing part on the side of the cable. According to the invention, a strain relief clamp is provided, which clamps the flat conductor strip essentially in the shape of a U, on the end of the housing part on the side of the cable.

7 Claims, 4 Drawing Sheets

PLUG CONNECTOR WITH STRAIN RELIEF CLAMP

BACKGROUND OF THE INVENTION

1. Field of the Invention

The present invention relates to a plug connector with a strain relief clamp according to the main Claim.

2. Background of the Related Developments

Such plug connectors are used, inter al, in airbag ignition systems, where compact construction and in particular, flat construction plug connectors, are important, since there is only a little height available for the incorporation of such a system into the steering wheel. In these applications, a 100% certainty that the electrical connection shall not be interrupted is an essential condition. If, during assembly, the electrical connection between the cable and the contact ends with possibly an electronic component such as a choke arranged between them, is interrupted in the plug connector through a tensile load, the airbag may not be released in an emergency.

The purpose of the present invention is that of providing a plug connector of the kind set out at the beginning of the present specification, with a strain relief clamp, which safely prevents any interruption of the wiring within the plug connector.

This purpose is solved by the present invention according to the Claims.

In the subsidiary Claims, preferred embodiments of the present invention are set out.

BRIEF DESCRIPTION OF THE DRAWINGS

The invention is more fully explained by the description of an embodiment example, with reference to drawings, where.

DETAILED DESCRIPTION OF THE PREFERRED EMBODIMENT(S)

Figure 1:
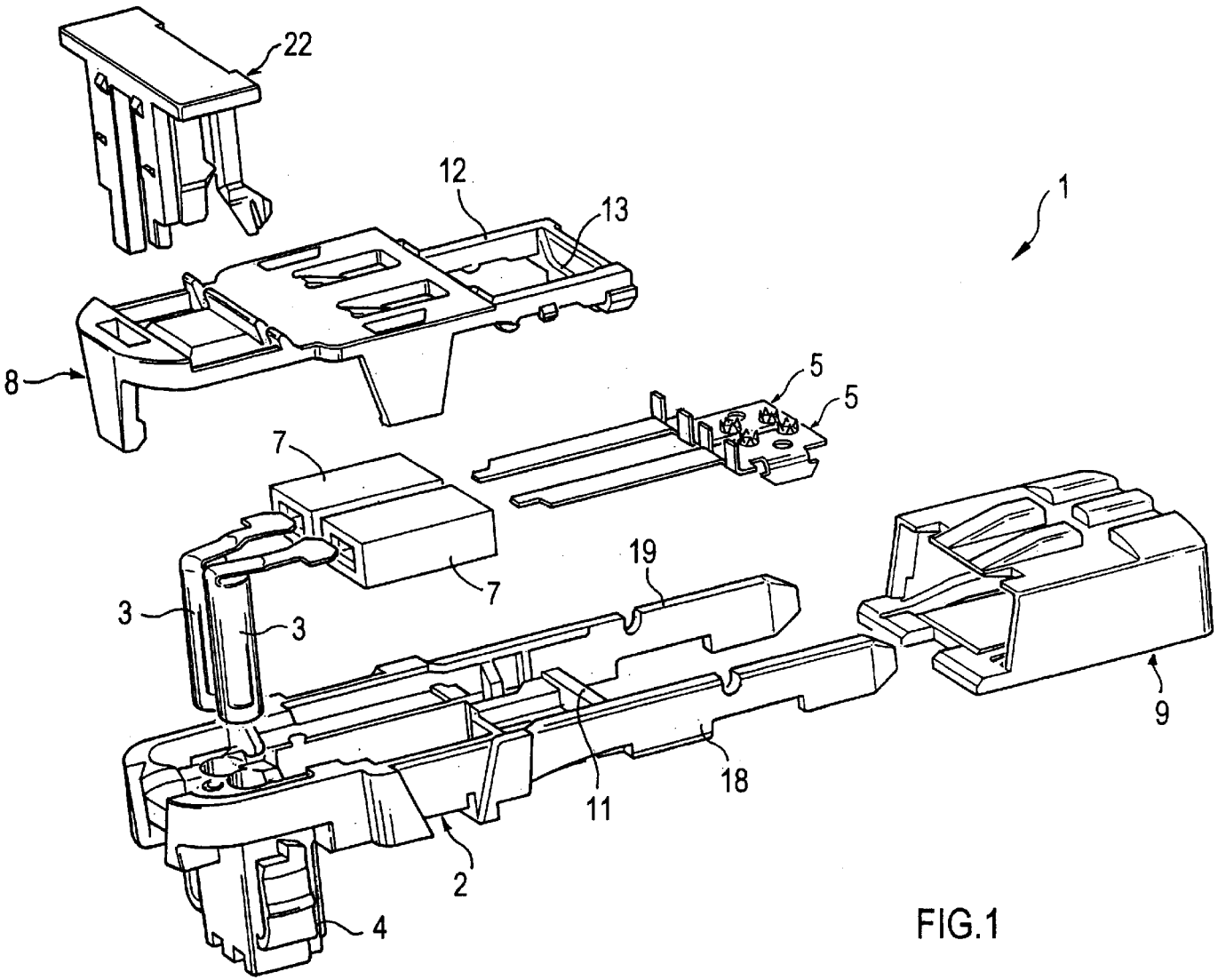
FIG. 1 shows an exploded view of an embodiment example of the plug connector according to the invention.

FIG. 1 shows the components of the plug connector 1 according to the invention. A first housing part 2 receives contact ends 3 in a plug 4, which is inserted into a corresponding counterplug. On the side of the cable, the contact ends 3 have contact frames, each of which, in the example shown, leads into a choke 7. This, in turn, is connected to a crimp plate 5, the end of which on the side of the cable has sharp-edged tips, by means of which the insulation of the flat conductor strip is pierced and contact with the flat conductor strip is established. A second housing part 8 is inserted on the first housing part 2 via locking arms.

The secondary locking device 22 is inserted through the second housing part as the plug 4. The second housing part has a strap 12 for holding a second bar 13, which is vertical to the length of the flat conductor strip 6. The first housing part 2 has at its end on the side of the cable, two limbs 18,19, between which is arranged a first bar 11. A third housing part 9 is, following the mutual insertion of the first and the second housing parts 2 and 8, inserted over the limbs 18,19, until it becomes locked into its final position.

Figure 2:
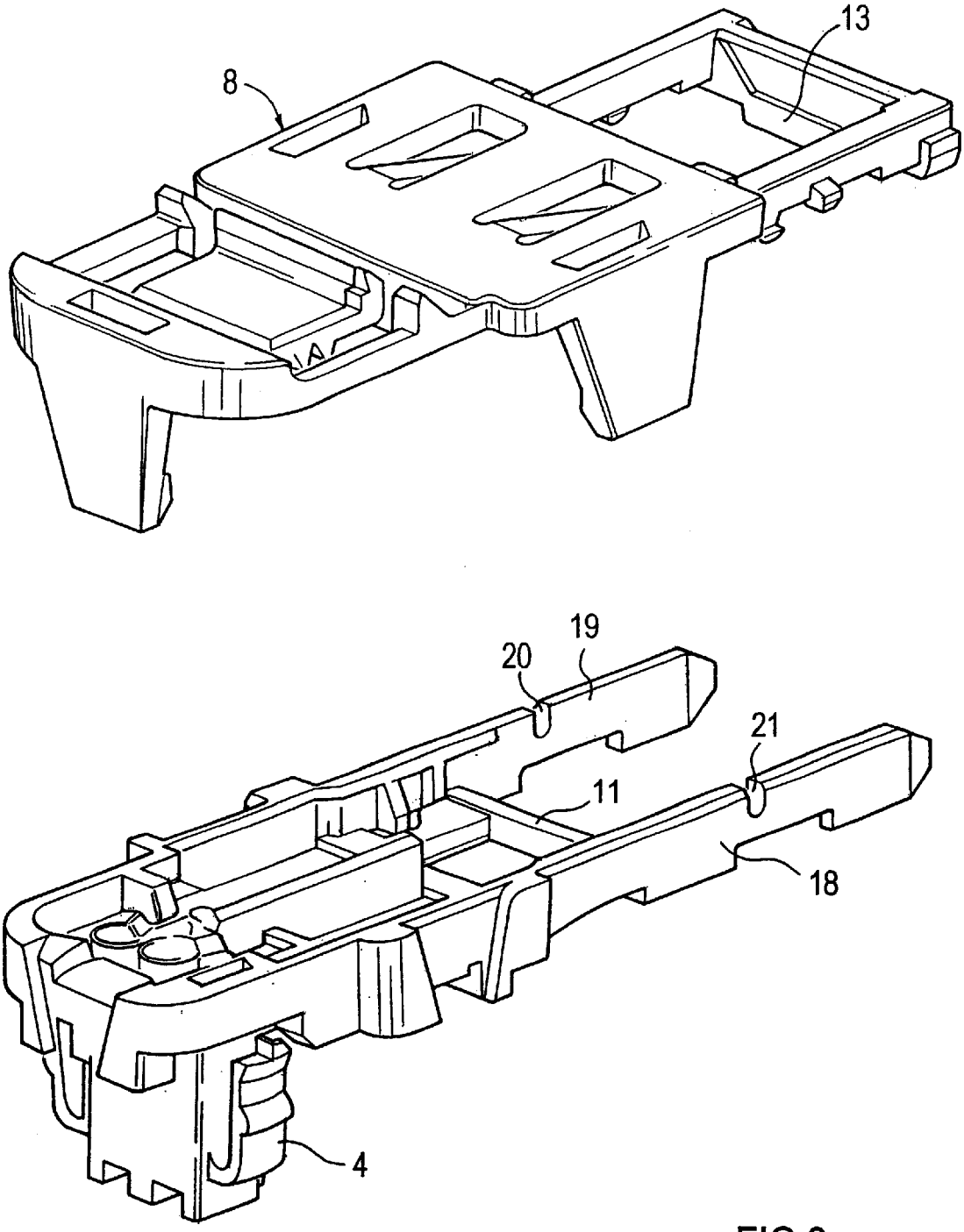
FIG. 2 shows a perspective view of the first and second housing part.

FIG. 2 shows an enlargement of the first and the second housing part. The second bar 13 of the second housing part 8 reaches, during the mutual insertion of the two housing parts and looking in the cable direction, behind the first bar of the first housing part and deforms stepwise the assembled flat conductor cable 6. During this process, the flat conductor cable 6 becomes clamped between the opposite side walls of the first and the second bar.

Figure 3:
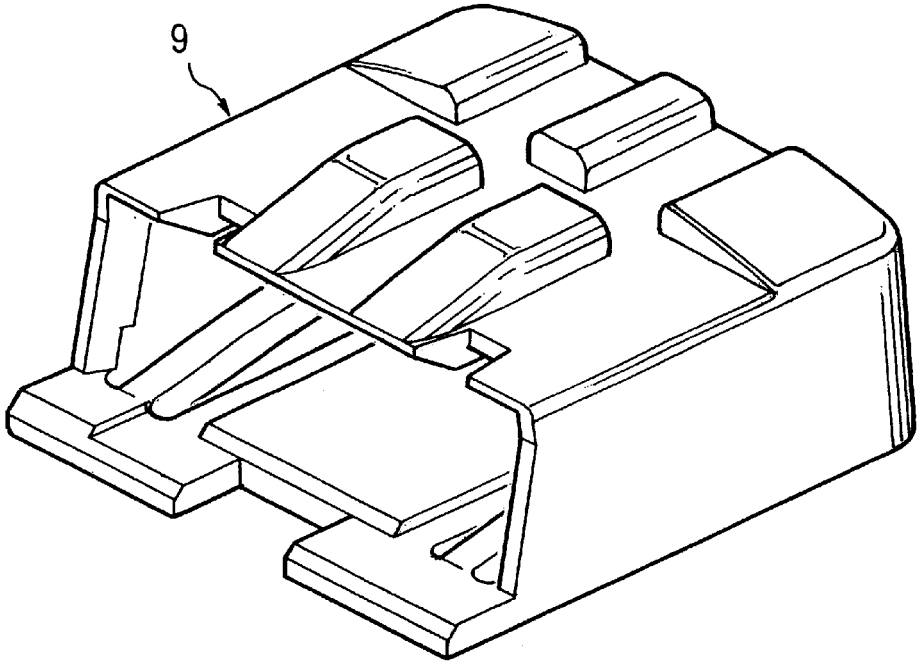
FIG. 3 shows a perspective view of the third housing part.
Figure 3:
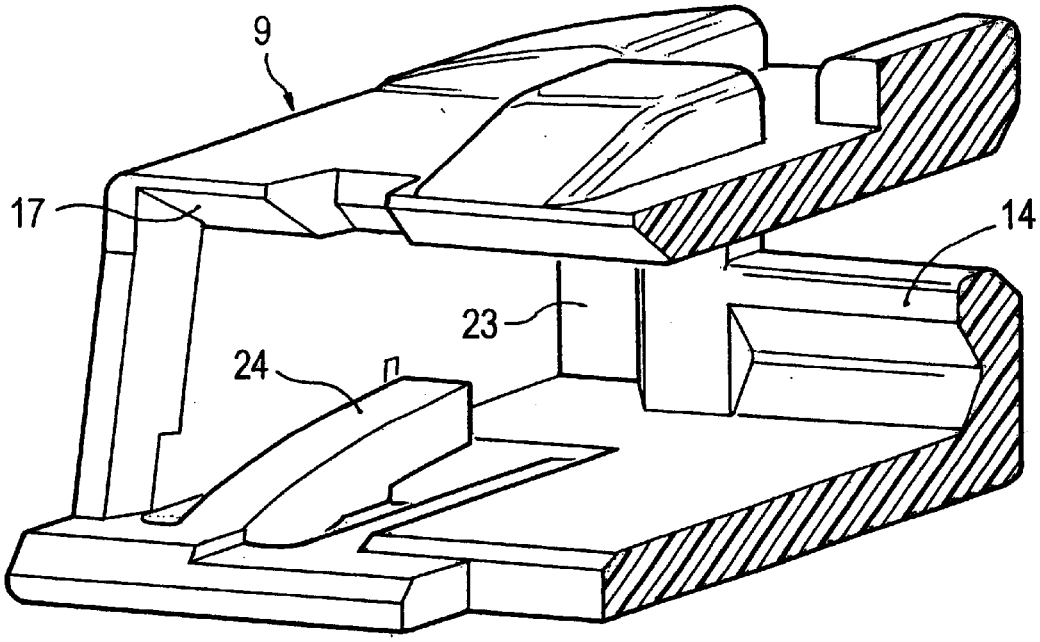

FIG. 3 shows two perspective views of the third housing part, which is inserted on the limbs 18, 19. It can be seen from the partially cut open representation that the wall of the third housing part 9 on the side of the cable, has a slot 23, which the front ends of the limb 18 or 19 push through during the mutual insertion of the housing parts. In the inserted condition, the projecting limb ends can be pinched off on the approximate level of the slot 23. For this purpose, a break-off point 20 is provided, which makes possible the defined breaking off of the limb ends. On the lateral walls of the third housing part 9 can also be seen internal locking ramps 24, which the limbs 18,19 with corresponding complementary recesses, lock into. The upper face of the third housing part has provided at its inner edge on the side of the connector, a ramp-shaped chamfer 17, which comes into contact with the upper edge of the second bar 13 during the process of the mutual insertion of the housing parts and which forces the strap 12 downwards. The lower edge of the second bar 13 is pressed against the surface of the flat conductor cable 6, so that the flat conductor cable becomes deformed.

A third bar 14 is provided at the end of the third housing part on the side of the cable. In the mutually inserted condition, the third bar immediately adjoins the second bar and lies in the same plane with the latter, as well as with the first bar. Looking behind the second bar, the flat conductor cable 6 is stepwise again bent upwards and clamped between the opposite lateral surfaces of the second and third bars 11 and 14. The flat conductor cable 6 emerges from the plug connector on the same level as that at which the end of the flat conductor cable is fixed to the crimp plate 5. The strain relief clamp 10 thus brings about a U-shaped deformation of the flat conductor cable and clamps it between the three bars. Any tearing out of the flat conductor cable is reliably prevented by means of the said clamping and by increased friction-generated retention.

Figure 4:
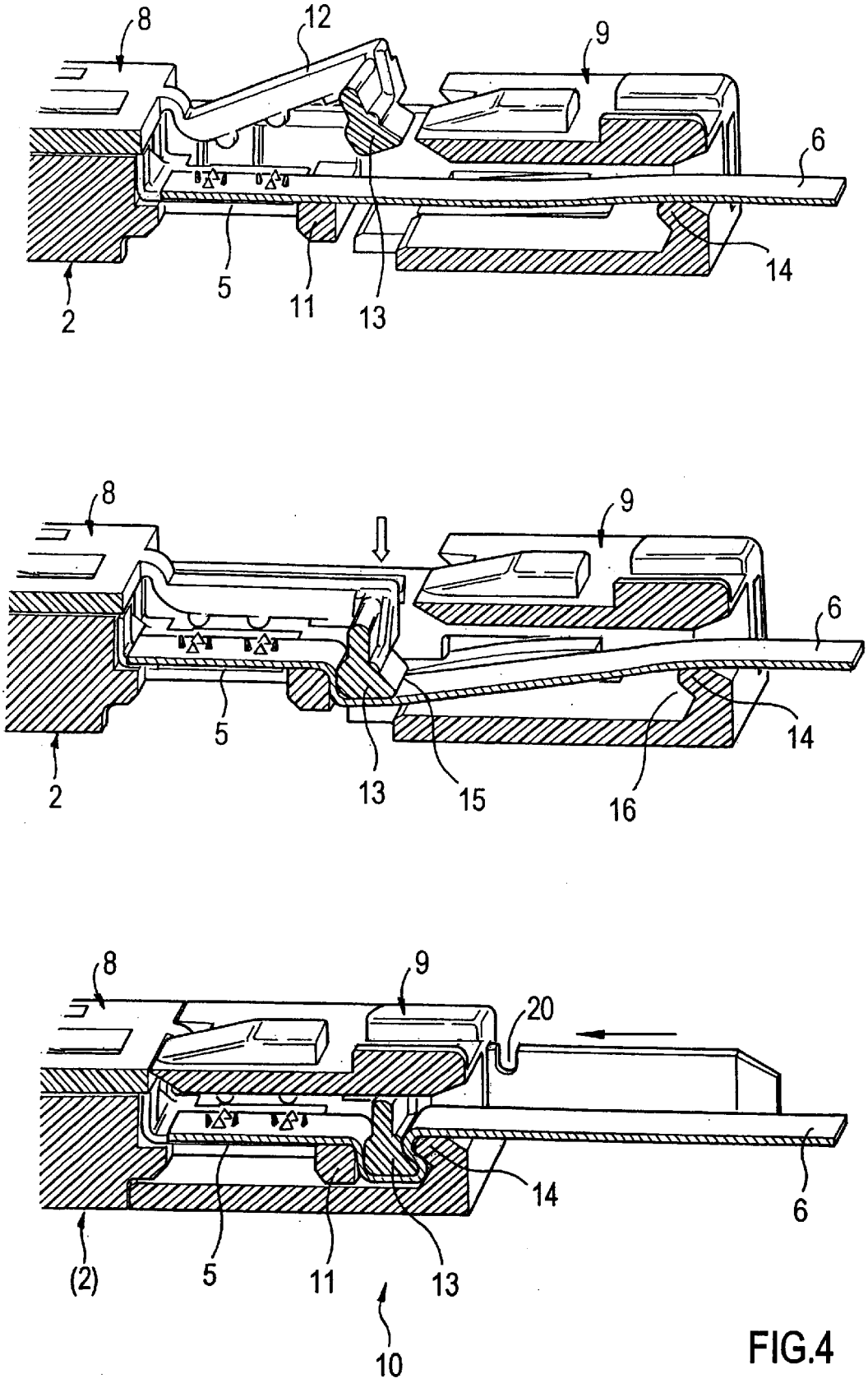
FIG. 4 shows the clamping procedure of the flat conductor cable during the insertion of the third housing part.

FIG. 4 shows the process of clamping, using the strain relief clamp according to the invention, during the mutual insertion of the third housing part 9 and the already mutually inserted first and second housing parts 2, 8. It can be seen from the top representation that the front edge of the strap 12 is bent slightly upwards. The front end of the flat conductor strip 6 is crimped to the crimp plate 5. By pressing down the strap 12, a first stage is stamped into the flat conductor cable 6 between the bars 11 and 13. During this process, the lower edge of the bar 13 presses the flat conductor cable 6 to the floor of the third housing part, which has already been inserted on the limbs 18, 19. At this stage, the third housing part can be pushed over the strap 12. During this process, the ramp-shaped front edge 17 of the upper face of the third housing part 9, presses the strap 12 down further and the second bar 13 on the flat conductor cable 6, which now becomes clamped between the first and the second bars 11,13 and the floor of the housing part 9. The third housing part is inserted until its front edge pushes against the corresponding faces of the first and second housing parts 2 and 8. When this position has been reached, the third housing part 9 is locked with the limbs 18,19 by the locking ramps 24 shown in FIG. 3. Simultaneously, the third bar 14 which is arranged at the end on the side of the cable of the third housing part 9, approaches the second stay 13 so closely that the flat conductor cable 6 passing between the opposite lateral walls of the second and third bar, is clamped between them. The lateral wall of the second bar 13 on the side of the cable, sustains an acute angle with the lower face, and the opposite lateral wall of the third bar 14 presses the flat conductor cable 6 until, as can be seen in the bottom illustration in FIG. 4, it has become S-shaped. By means of the clamping of the flat conductor cable between any lateral walls of the bars and through the acute angle pinching of the conductor cable, the frictional retention forces between the bars and the flat conductor cover become so high, that an extraction of the flat conductor cable 6 from the mutually inserted plug connectors according to the invention, is no longer possible.

The preceding description of an embodiment example of the present invention is not to be understood as being limiting, but as covering all variants which are represented by the wording of the Claims.

What is claimed is:

1. A plug connector with a first lower housing part in which contact ends are arranged in a plug, crimp plates for crimping a a flat conductor cable the crimp plates having a front end that may be connected to the contact ends with an intervening choke or a different electronic component, a second housing part which is inserted as a cover on the first housing part and a third housing part which is inserted on the first housing part on the side of the cable, wherein when connected to each other, the first housing part, second housing part and third housing part cooperate with each other to define a strain relief clamp that clamps the flat conductor cable essentially in the form of a U, at the end of the third housing part on the side of the cable.

2. A plug connector with a first lower housing part in which contact ends are arranged in a plug, crimp plates to the back end of which a flat conductor cable is crimped and whose front end may be connected to the contact ends with an intervening choke or a different electronic component, a second housing part which is inserted as a cover on the first housing part and a third housing part which is inserted on the first housing part on the side of the cable, wherein a strain relief clamp clamps the flat conductor cable essentially in the form of a U, at the end of the third housing part on the side of the cable, wherein each of the three housing parts has a bar oriented crosswise to the flat conductor cable and during mutual insertion of the three housing parts, the flat conductor cable is deformed into the shape of a U by and clamped between the three bars.

3. A plug connector with a first lower housing part in which contact ends are arranged in a plug, crimp plates to the back end of which a flat conductor cable is crimped and whose front end may be connected to the contact ends with an intervening choke or a different electronic component, a second housing part which is inserted as a cover on the first housing part and a third housing part which is inserted on the first housing part on the side of the cable, wherein a strain relief clamp clamps the flat conductor cable essentially in the form of a U, at the end of the third housing part on the side of the cable, wherein the strain relief clamp is formed by the first bar placed crosswise to the flat conductor cable on the first housing part, a strap arranged on the second housing part with a second bar which bends the flat conductor cable stepwise over the upper edge of the first bar on the side of the cable and a third cross-bar on the lower edge of the cable emerging from the third housing part, with which the flat conductor cable on the side of the lower edge of the second bar, is stepwise pinched upwards and led out of the third housing part.

4. A plug connector according to claim 3, wherein the lower face of the second bar sustains an acute angle with the lateral wall on the side of the cable and the third bar has a supplementary lateral wall on the side of the connector, whereby the flat conductor strip is essentially bent into an S shape.

5. A plug connector according to claim 3, wherein the third housing part has a ramp on the inside of its upper edge on the side of the connector, by which the second bar becomes pressed downwards during insertion of the third housing part on the first housing part.

6. A plug connector according to claim 3, wherein the first bar is fixed to the first housing part via two limbs running parallel to the flat conductor cable, where the third housing part is inserted and locked on the limbs.

7. A plug connector according to claim 6, wherein the limbs are extended for leading the third housing part during insertion on the first housing part and can be pinched off at break-off points of the limb ends protruding, in the locked condition, from an end of the third housing part.

* * * * *